US012161243B1

(12) United States Patent
Easterwood

(10) Patent No.: US 12,161,243 B1
(45) Date of Patent: Dec. 10, 2024

(54) CLOTHING ASSIST APPARATUS AND METHOD

(71) Applicant: Dean C. Easterwood, Milton, FL (US)

(72) Inventor: Dean C. Easterwood, Milton, FL (US)

( * ) Notice: Subject to any disclaimer, the term of this patent is extended or adjusted under 35 U.S.C. 154(b) by 0 days.

(21) Appl. No.: 18/110,401

(22) Filed: Feb. 16, 2023

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/905
See application file for complete search history.

(56) References Cited

U.S. PATENT DOCUMENTS 3,070,271 A * 12/1962 Kennedy, Sr. ..... A47G 25/905 223/111
3,227,335 A * 1/1966 Minnema ..... A47G 25/905 223/111
5,632,424 A * 5/1997 Maier ..... A47G 25/905 223/111
9,445,680 B2 * 9/2016 Bean ..... A47G 25/90
11,497,334 B2 * 11/2022 Leonard ..... A43D 119/00
2019/0159618 A1 * 5/2019 Kucera ..... A47G 25/90
2019/0335933 A1 * 11/2019 Leeper ..... A47G 25/90

* cited by examiner

*Primary Examiner* — Ismael Izaguirre
(74) *Attorney, Agent, or Firm* — J. Nevin Shaffer, Jr.

(57) ABSTRACT

A clothing assist apparatus and method with a frame with a front side, a rear side, a left side and a right side. Two front uprights and two rear uprights are provided where the two front uprights are spaced apart from each other on the front side and the two rear uprights are spaced apart from each other on the rear side and the two front uprights are spaced apart from the two rear uprights by the left side and the right side. Additionally, at least one handle is connected to the frame.

18 Claims, 6 Drawing Sheets

CLOTHING ASSIST APPARATUS AND METHOD

FIELD OF THE INVENTION

This invention relates to a clothing assistance device. In particular, in accordance with one embodiment, the invention relates to a clothing assist apparatus consisting of a frame with a front side, a rear side, a left side and a right side. Two front uprights and two rear uprights are provided where the two front uprights are spaced apart from each other on the front side and the two rear uprights are spaced apart from each other on the rear side and the two front uprights are spaced apart from the two rear uprights by the left side and the right side. Additionally, at least one handle is connected to the frame.

BACKGROUND OF THE INVENTION

Generally speaking, other than babies, most people do not have any particular problem in dressing themselves. However, a problem exists in this regard for people that have a physical disability due to accident, genetics or age. Collectively, there is a very large group of people that simply cannot bend over to put on their underwear, incontinence briefs, or pants.

Thus, there is a need in the art for a device that enables users to safely dress themselves without fear of falling and injury.

It therefore is an object of this invention to provide a clothing assist device for enabling a user to safely put on clothing without bending over.

It is a further object of the invention to provide a clothing assist apparatus and method that is easy to use and reuse and that is inexpensive to create and, when used, removes the fall hazard from bending over to dress.

SUMMARY OF THE INVENTION

Accordingly, the clothing assist apparatus and method of the present invention, according to one embodiment, includes a frame with a front side, a rear side, a left side and a right side. Two front uprights and two rear uprights are provided where the two front uprights are spaced apart from each other on the front side and the two rear uprights are spaced apart from each other on the rear side and the two front uprights are spaced apart from the two rear uprights by the left side and the right side. Additionally, at least one handle is connected to the frame.

All terms used herein are given their common meaning as shown in the Figures and described herein, so that "clothing" identifies and describes a material that includes underwear, incontinence briefs and pants, by way of example only and not by limitation.

According to one aspect of the invention just described, there is an open space in the rear side between the two rear uprights.

In one aspect, the front side is longer than the rear side.

In another aspect, there is a right side handle and a left side handle and the right side handle and the left side handle are connected to the front side and the two front uprights are connected to the front side in between the right side handle and the left side handle.

In one aspect, the apparatus is made of PVC material.

In one aspect, the clothing assist apparatus is configured to assist with clothing from a group consisting of: underwear, incontinence briefs and trousers.

According to another embodiment of the invention, a clothing assist apparatus consists of a frame with a front left corner, a front right corner, a rear left corner and a rear right corner. A front left spacer is connected with the front left corner and a front right spacer is connected with the front right corner. A front left upright is connected with the front left spacer and a front right upright is connected with the front right spacer such that the front left upright is spaced apart from the front right upright. Further, a rear left spacer is connected with the rear left corner and a rear right spacer is connected with the rear right corner and a rear left upright is connected with the rear left spacer and a rear right upright is connected with the rear right spacer such that the rear left upright is spaced apart from the rear right upright. A left side is connected between the front left corner and the rear left corner and a right side is connected between the front right corner and the rear right corner such that the two front uprights are spaced apart from the two rear uprights by the left side and the right side. A left side handle is connected to the front left corner and a right side handle connected to the front right corner.

One aspect further includes a front side center connection section where the front side center connection section connects the front left upright and the front right upright.

In one aspect, there is an open space between the rear left upright and the rear right upright.

In another aspect, a length between the front left corner and the front right corner is longer than a length between the rear left corner and the rear right corner.

In one aspect, the clothing assist apparatus is configured to assist with clothing from a group of clothing consisting of: underwear, incontinence briefs and trousers.

According to another embodiment, a clothing assist method consists of:

a. providing a frame with a front side, a rear side, a left side and a right side; two front uprights and two rear uprights where the two front uprights are spaced apart from each other on the front side and where the two rear uprights are spaced apart from each other on the rear side and where the two front uprights are spaced apart from the two rear uprights by the left side and the right side and a right side handle and a left side handle connected to the frame; and b. attaching clothing with leg holes to the uprights, placing one user's leg in one leg hole and one user's leg in another leg hole and lifting the handles to draw the clothing up the user's legs.

In one aspect, the clothing with leg holes includes a left leg hole and a right leg hole and the two front uprights include a front left upright and a front right upright and the two rear uprights include a rear left upright and a rear right upright and further includes the steps of:

a. placing the left leg hole over the front left upright;
b. placing the right leg hole over the front right upright;
c. placing the left leg hole over the rear left upright;
d. placing the right leg hole over the rear fight upright;
e. placing a left leg in the left leg hole; and
f. placing a right leg in the right leg hole.

In another aspect, after drawing the clothing up the legs, the method further includes:

a. grasping the clothing and pulling the clothing off of the uprights; and b. releasing the handles once the clothing is removed from the uprights.

In one aspect, there is an open space in the rear side between the two rear uprights.

In another aspect, the front side is longer than the rear side.

In another aspect, the right side handle and the left side handle are connected to the front side and the two front uprights are connected to the front side in between the right side handle and the left side handle.

In one aspect, the clothing assist apparatus is configured to assist with clothing from a group of clothing consisting of: underwear, incontinence briefs and trousers.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
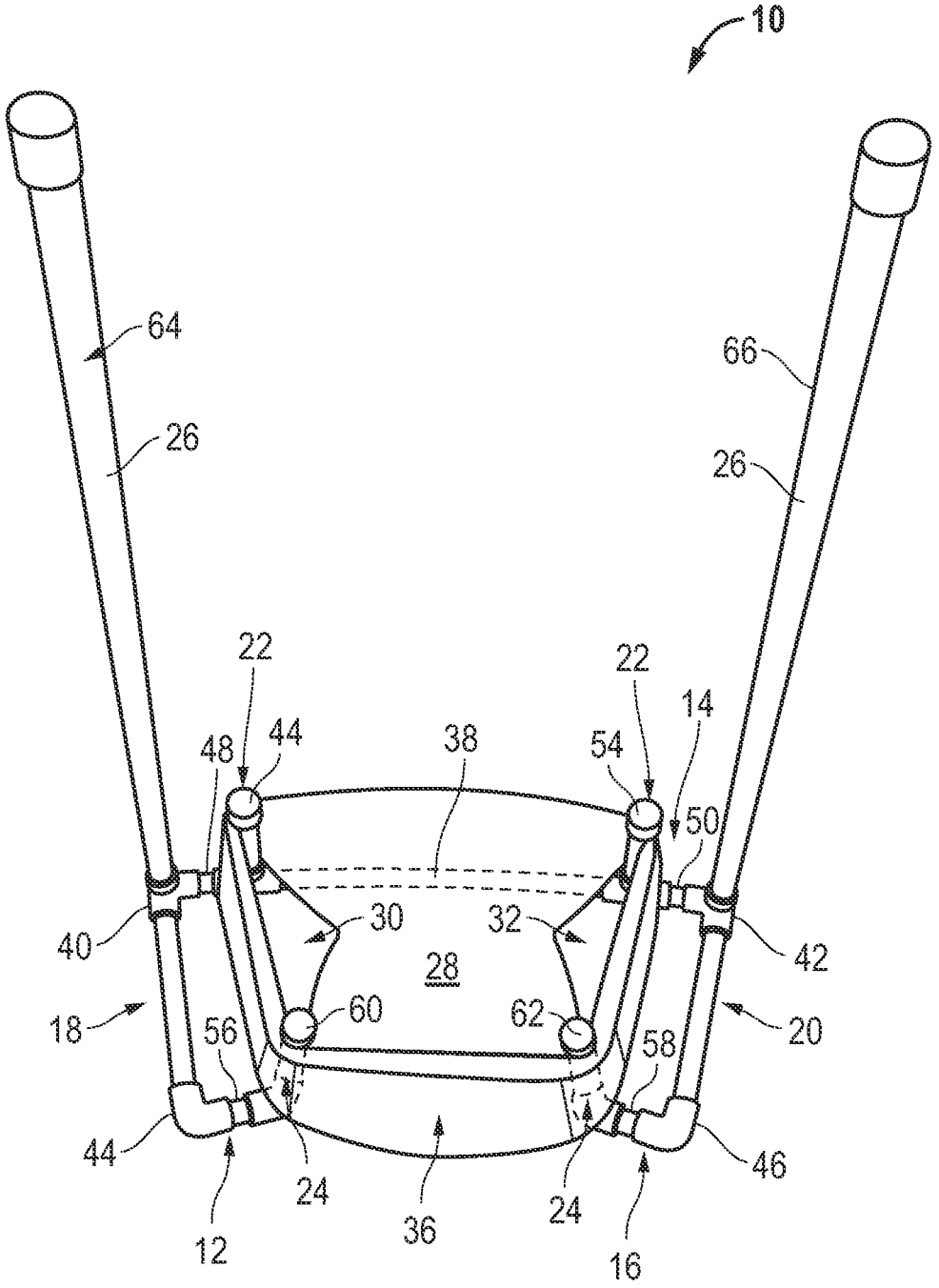
FIG. 1 is a perspective view of the clothing assist apparatus of the present invention shown with clothing attached to the uprights.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain steps are conducted in parallel or independent, with other steps, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-10. With specific reference to FIGS. 1 and 2, the clothing assist apparatus 10 of the present invention, according to one embodiment, includes a frame 12 with a front side 14, a rear side 16, a left side 18 and a right side 20. Two front uprights 22 and two rear uprights 24 are provided where the two front uprights 22 are spaced apart from each other on the front side 14 and the two rear uprights 24 are spaced apart from each other on the rear side 16 and the two front uprights 22 are spaced apart from the two rear uprights 24 by the left side 18 and the right side 20 as illustrated.

Additionally, at least one handle 26 is connected to the frame 12. As illustrated and as preferred, two handles 26 are generally provided to accommodate user preferences and abilities. Also, while handle 26 may be attached to frame 12 in any desired location, preferably, two handles 26 are attached to frame 12 such that the front uprights 22 are in between the two handles 26 as shown. This enables a user 34 to attach and remove clothing 28 without interference from the handle(s) 26.

Clothing 28 is shown attached to both the two front uprights 22 and the two rear uprights 24. Clothing assist apparatus 10 is configured to capture the left leg hole 30 and the right leg hole 32 of clothing 28. FIG. 1 shows clothing 28 in the form of incontinence briefs but, as can be understood, any clothing 28 with leg holes, such as underwear and trousers, for example only and not by limitation, may be used with clothing assist apparatus 10. FIG. 1 shows clothing 28 in place on the clothing assist apparatus 10 and ready for a user 34 (see FIGS. 6-10) to put on, as will be described more fully hereafter.

Figure 2:
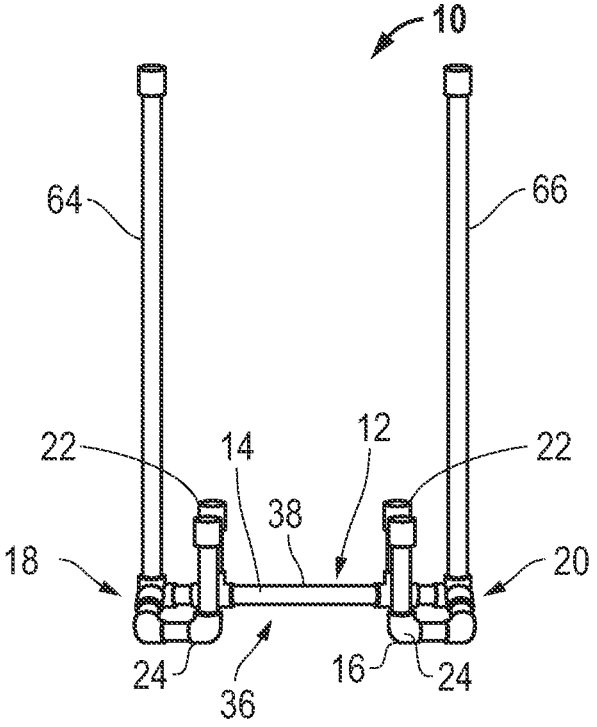
FIG. 2 is a perspective view of the invention of FIG. 1 without clothing attached.

Preferably, there is an open space 36 in the rear side 16 between the two rear uprights 24 and preferably, the front side 14 includes a front side center section 38 as more clearly shown in FIG. 2. In one aspect, the front side 14 is longer than the rear side 16 as shown in FIG. 1. Certainly, the front side 14 and the rear side 16 may be the same length or any desired lengths found useful. Together, however, this structure has been found to create a curve and expand the leg holes of clothing 28 for ease of inserting a user's legs. Once the clothing 28 is in place on a user 34, the space 36 allows a user 34 to pass the clothing assist apparatus 10 by the user's legs (see also FIG. 10).

By way of further description, still referring to FIGS. 1 and 2, according to one embodiment of the invention, clothing assist apparatus 10 more particularly consists of a frame 12 with a front left corner 40, a front right corner 42, a rear left corner 44 and a rear right corner 46. A front left spacer 48 is connected with the front left corner 40 and a front right spacer 50 is connected with the front right corner 42. A front left upright 52 is connected with the front left spacer 48 and a front right upright 54 is connected with the front right spacer 50 such that the front left upright 52 is spaced apart from the front right upright 54. Further, a rear left spacer 56 is connected with the rear left corner 44 and a rear right spacer 58 is connected with the rear right corner 46. A rear left upright 60 is connected with the rear left spacer 56 and a rear right upright 62 is connected with the rear right spacer 58 such that the rear left upright 60 is spaced apart from the rear right upright 62.

Left side 18 is connected between the front left corner 40 and the rear left corner 44. Right side 20 is connected between the front right corner 42 and the rear right corner 46 such that the two front uprights, 52 and 54, are spaced apart from the two rear uprights, 60 and 62, by the left side 18 and the right side 20. Preferably, a left side handle 64 is connected to the front left corner 40 and a right side handle 66 connected to the front right corner 42 all as illustrated.

Figure 3:
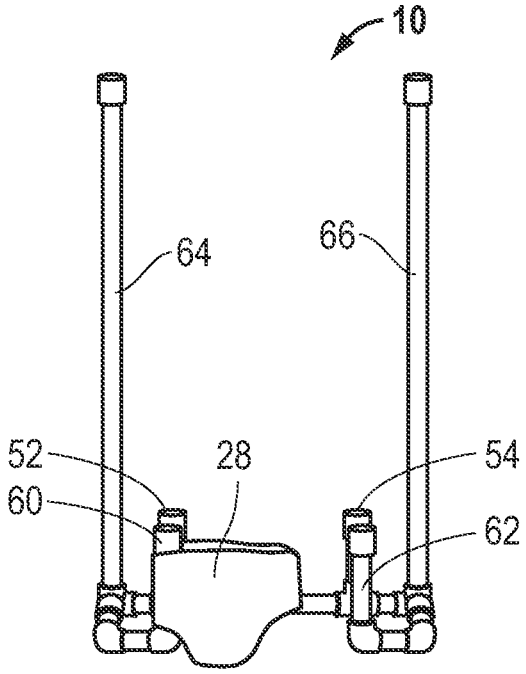
FIG. 3 is a perspective view of the invention of FIG. 1 with clothing attached to the front left upright.
Figure 4:
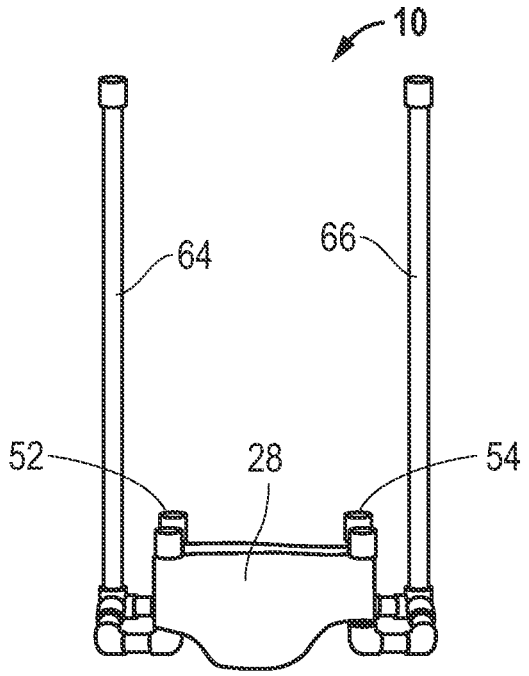
FIG. 4 is a perspective view of the invention of FIG. 3 with clothing also attached to the front right upright.
Figure 5:
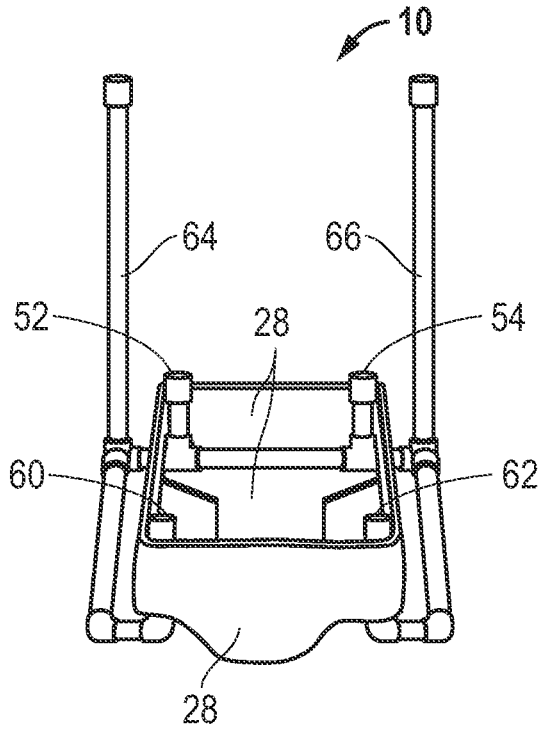
FIG. 5 is a perspective view of the invention of FIG. 4 with clothing attached to the front and rear uprights.

Referring now to FIGS. 3-10, the process of using clothing assist apparatus 10 is described. In FIG. 3, attaching clothing 28 to clothing assist apparatus 10 begins, for example only and not by limitation, by placing left leg hole 30 (not shown for clarity) over front left upright 52. FIG. 4 shows right leg hole 32 (not shown for clarity) placed over front right upright 54. FIG. 5 shows left leg hole 30 placed over rear left upright 60 and right leg hole 32 placed over rear right upright 62. In this position, clothing 38 leg holes 30 and 32 are fully open and held open by the present invention such that a user 34 can easily slip his or her legs into the leg holes 30 and 32.

Figure 6:
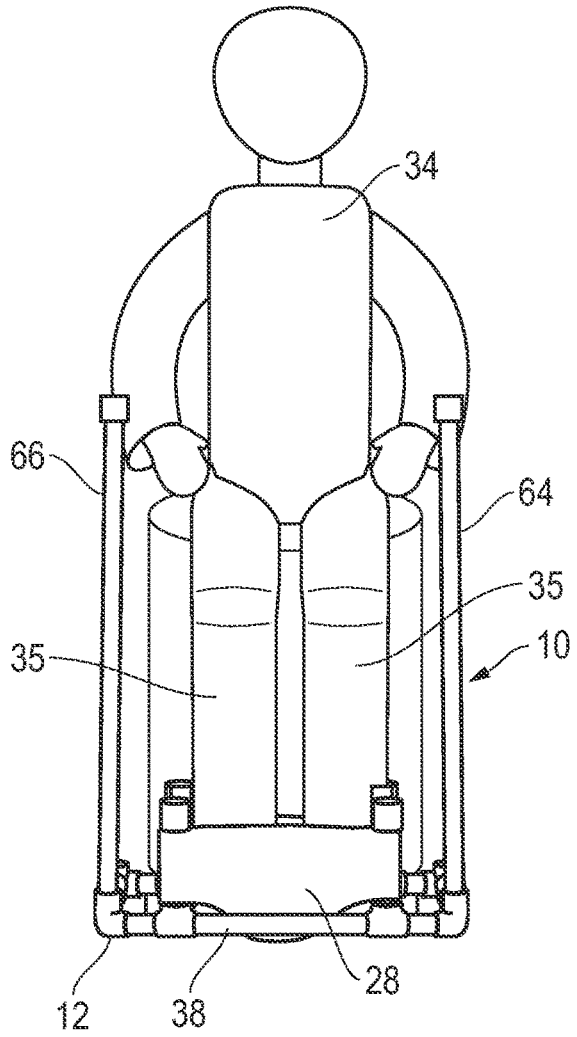
FIG. 6 is a front view of a seated user with a left leg and right leg inserted into the clothing attached to the front and rear uprights.

FIG. 6 shows a user 34 seated which illustrates a significant important feature of the present invention. That is, many people are not able to stand while dressing, particularly the initial process of putting their legs through the leg holes and find trying to dress while seated, particularly when putting on underwear, nearly impossible without assistance.

Figure 7:
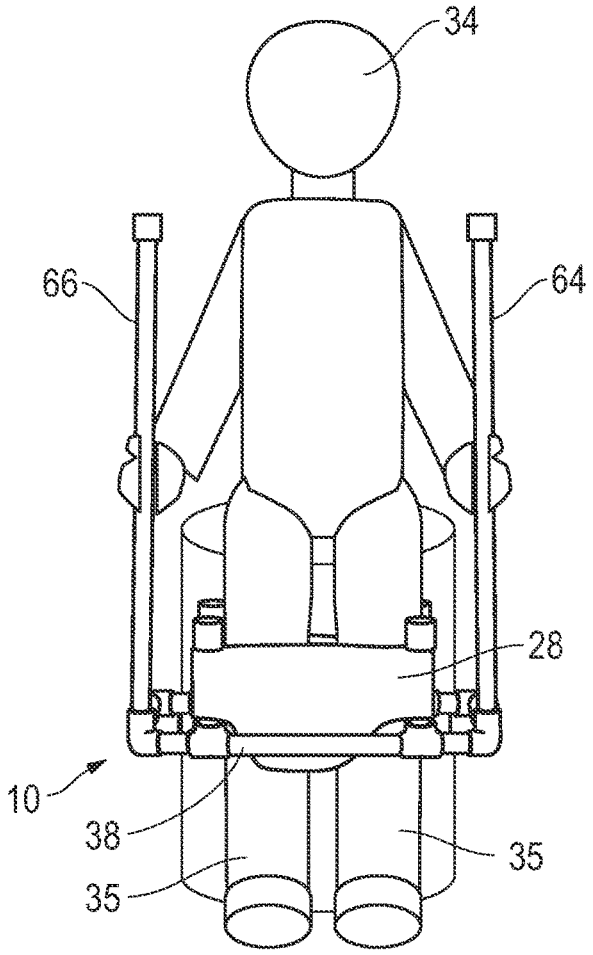
FIG. 7 is a front view of the invention of FIG. 6 showing the user lifting the clothing up his legs with the handle attached to the invention.

By way of the present invention, as shown in FIG. 7, however, the user 34 simply places his or her legs 35 in the leg holes 30 and 32 and lifts the handle(s) 64 and 66 thereby drawing clothing 28 up his or her legs 35 without needing to bend over and all while seated.

Figure 8:
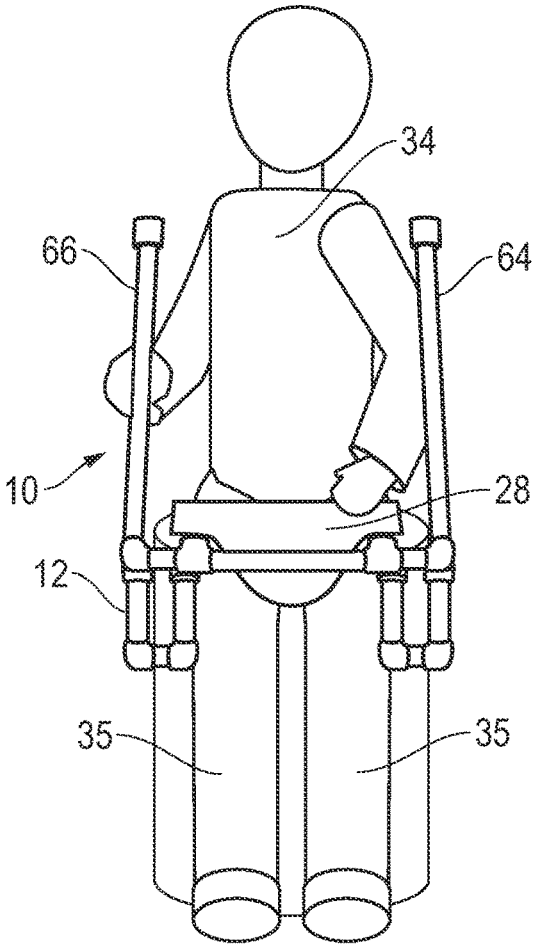
FIG. 8 is a front view of the invention of FIG. 7 showing the user standing and holding the clothing and the handle after pulling the clothing within reach.
Figure 9:
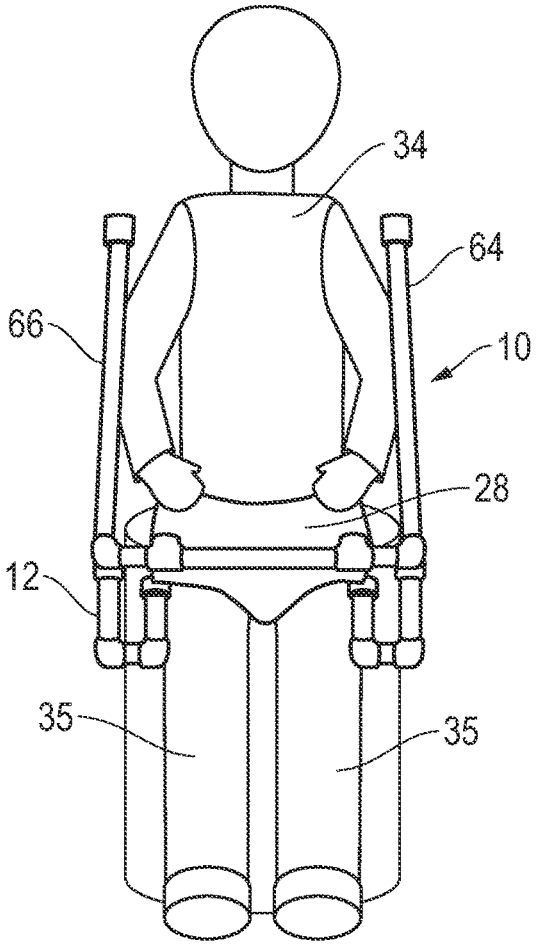
FIG. 9 is a front view of the invention of FIG. 8 with the user holding the clothing and letting go of the clothing assist apparatus.
Figure 10:
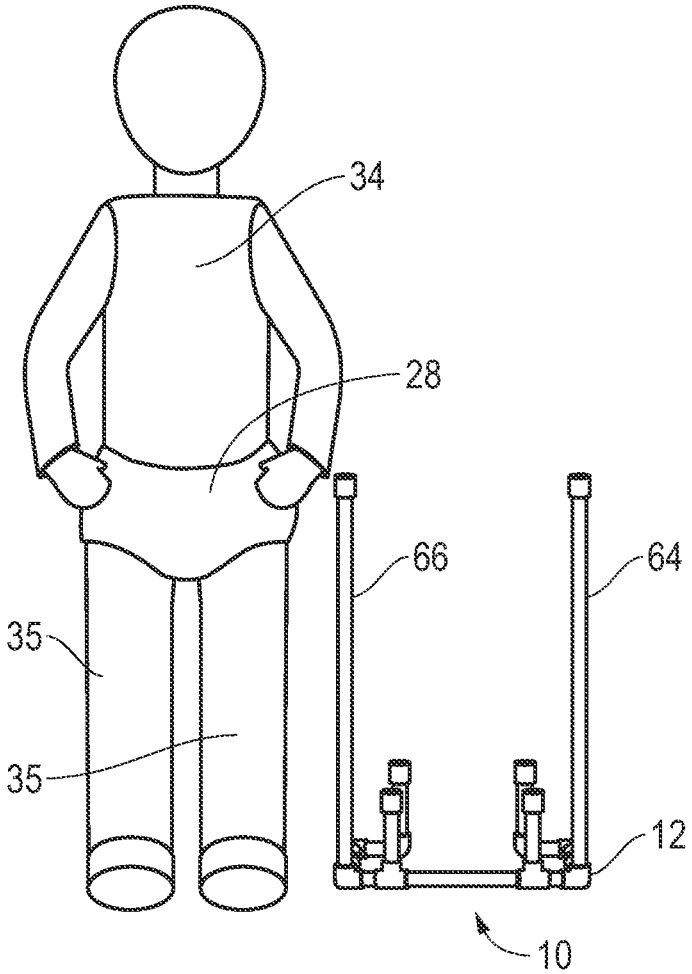
FIG. 10 is a front view of the invention of FIG. 9 with the user with clothing in place and the clothing assist apparatus to the side.

FIG. 8 illustrates the process facilitated by the present invention whereby a user 34, once the clothing 28 has been lifted up his or her legs 35 sufficiently, grasps the clothing 28 with one hand, and stands, and then, in FIG. 9 grasps the clothing with both hands, thereby removing the clothing 28 from the uprights 52, 54, 60 and 62, while releasing clothing assist apparatus 10. In FIG. 10, the user 34 has fully positioned the clothing 28 and stepped out of and away from clothing assist apparatus 10 which remains upright and ready for reuse as needed.

The description of the present embodiments of the invention has been for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A clothing assist apparatus comprising:

a. a frame with a front side, a rear side, a left side and a right side wherein said front side is longer than said rear side;

b. two front side uprights and two rear side uprights wherein said two front side uprights are spaced apart from each other on the front side and wherein said two rear side uprights are spaced apart from each other on the rear side and wherein said two front side uprights are spaced apart from said two rear side uprights by said left side and said right side; and c. at least one handle connected to said frame.

2. The apparatus of claim 1 wherein there is an open space in said rear side between said two rear side uprights.

3. The apparatus of claim 1 wherein there is a right side handle and a left side handle and said right side handle and said left side handle are connected to the front side and wherein said two front side uprights are connected to the front side in between said right side handle and said left side handle.

4. The apparatus of claim 1 wherein said apparatus is made of PVC.

5. The apparatus of claim 1 wherein said clothing assist apparatus is configured to assist with clothing from a group consisting of: underwear, incontinence briefs and trousers.

6. A clothing assist apparatus comprising:

a. a frame with a front left corner, a front right corner, a rear left corner and a rear right corner wherein a length between said front left corner and said front right corner is longer than a length between said rear left corner and said right rear corner;

b. a front left spacer connected with said front left corner and a front right spacer connected with said front right corner;

c. a front left upright connected with said front left spacer and a front right upright connected with said front right spacer such that said the front left upright is spaced apart from the front right upright;

d. a rear left spacer connected with said rear left corner and a rear right spacer connected with said rear right corner;

e. a rear left upright connected with said rear left spacer and a rear right upright connected with said rear right spacer such that the rear left upright is spaced apart from said rear right upright;

f. a left side connected between said front left corner and said rear left corner and a right side connected between said front right corner and said rear right corner wherein said two front uprights are spaced apart from said two rear uprights by said left side and said right side; and g. a left side handle connected to said front left corner and a right side handle connected to said front right corner.

7. The apparatus of claim 6 further including a front side center connection section wherein said front side center connection section connects said front left upright and said front right upright.

8. The apparatus of claim 6 wherein there is an open space between said rear left upright and said rear right upright.

9. The apparatus of claim 6 said apparatus is made of PVC.

10. The apparatus of claim 6 wherein said clothing assist apparatus is configured to assist with clothing from a group consisting of: underwear, incontinence briefs and trousers.

11. A clothing assist method consisting of:

a. providing a frame with a front side, a rear side, a left side and a right side wherein said front side is longer than said rear side; two front uprights and two rear uprights wherein said two front uprights are spaced apart from each other on the front side and wherein said two rear uprights are spaced apart from each other on the rear side and wherein said two front uprights are spaced apart from said two rear uprights by said left side and said right side and a right side handle and a left side handle connected to said frame; and b. attaching clothing with leg holes to said uprights, placing one user's leg in one leg hole and one user's leg in another leg hole and lifting said handles to draw the clothing up the user's legs.

12. The method of claim 11 wherein said clothing with leg holes includes a left leg hole and a right leg hole and the two front uprights include a front left upright and a front right upright and the two rear uprights include a rear left upright and a rear right upright and further includes the steps of:

a. placing the left leg hole over the front left upright;

b. placing the right leg hole over the front right upright;

c. placing the left leg hole over the rear left upright;

d. placing the right leg hole over the rear right upright;

e. placing a left leg in the left leg hole; and f. placing a right leg in the right leg hole.

13. The method of claim 12 after drawing the clothing up the legs, further including:

a. grasping the clothing and pulling the clothing off of the uprights; and b. releasing the handles once the clothing is removed from the uprights.

14. The method of claim 11 wherein there is an open space in said rear side between said two rear uprights.

15. The method of claim 11 wherein said right side handle and said left side handle are connected to the front side and wherein said two front uprights are connected to the front side in between said right side handle and said left side handle.

16. The method of claim 11 wherein said apparatus is made of PVC.

17. The method of claim 11 wherein said clothing assist apparatus is configured to assist with clothing from a group of clothing consisting of: underwear, incontinence briefs and trousers.

18. The apparatus of claim 1 further including a front side center connection section wherein said front side center connection section connects said front left upright and said front right upright.

* * * * *